US005656148A

United States Patent [19]

Martyak et al.

[11] Patent Number: 5,656,148

[45] Date of Patent: Aug. 12, 1997

[54] HIGH CURRENT DENSITY ZINC CHLORIDE ELECTROGALVANIZING PROCESS AND COMPOSITION

[75] Inventors: Nicholas M. Martyak, Doyletown, Pa.; John E. McCaskie, Bedminster, N.J.

[73] Assignee: Atotech USA, Inc., Somerset, N.J.

[21] Appl. No.: 397,479

[22] Filed: Mar. 2, 1995

[51] Int. Cl.[6] ..... C25D 3/22

[52] U.S. Cl. ..... 205/311; 205/313; 205/244

[58] Field of Search ..... 205/244, 311, 205/312, 313, 314

[56] References Cited

U.S. PATENT DOCUMENTS

| | | | |
|---|---|---|---|
| 2,849,351 | 8/1958 | Gundel et al. | 205/313 |
| 3,957,595 | 5/1976 | DuBrow et al. | 204/44 |
| 3,960,677 | 6/1976 | Hildering et al. | 204/44. |
| 4,119,502 | 10/1978 | Arcilesi | 205/313 |
| 4,137,133 | 1/1979 | Arcilesi | 204/55 R |
| 4,229,268 | 10/1980 | Lowery et al. | 205/313 |
| 4,379,738 | 4/1983 | Kohl | 204/55 R |
| 4,512,856 | 4/1985 | Paneccasio | 205/313 |
| 4,515,663 | 5/1985 | Strom et al. | 204/55 R |
| 4,581,110 | 4/1986 | Tsuchida et al. | 204/44.2 |
| 4,797,183 | 1/1989 | Yamamoto et al. | 204/55.1 |
| 4,877,497 | 10/1989 | Watanabe et al. | 204/55.1 |
| 5,200,057 | 4/1993 | Canaris | 205/313 |

*Primary Examiner*—Bruce F. Bell
*Assistant Examiner*—Kishor Mayekar
*Attorney, Agent, or Firm*—Finnegan, Henderson, Farabow, Garrett, and Dunner, L.L.P.

[57] ABSTRACT

An electrogalvanizing process and composition are disclosed for reducing high current density dendrite (HCD) formation and edge burn and controlling high current density roughness, grain size and orientation of a zinc coating obtained from a zinc halide aqueous acidic electrogalvanic coating bath. A low molecular weight polyoxyalkylene glycol homopolymer or copolymer based on 3 to about 4 carbon atom alkylene oxides as a grain refining agent in combination with a sulfonated condensation product of naphthalene and formaldehyde which is used as an antidendritic agent. A glycol compound comprising a high molecular weight polyoxyalkylene glycol homopolymer or copolymer, a depolarizer such as an aniline compound, and a carbamate compound comprising a di-lower alkyl dithio carbamyl lower alkyl sulfonic acid may also be used, optionally in combination with an aldehyde and/or a grain refining agent such as a low molecular weight polyoxyalkylene glycol homopolymer or copolymer and/or an antidendritic agent comprising a sulfonated condensation product of naphthalene and formaldehyde. HCD zinc coatings applied according to the process described herein will be smoother when using a sulfonated naphthalene formaldehyde antidendritic agent and a low molecular weight ethylene oxide polymer grain refining agent by increasing the antidendritic agent to an amount greater than the grain refining agent. A boron oxide composition can be used to further reduce HCD burn and a lignin compound to increase brightness.

25 Claims, No Drawings

HIGH CURRENT DENSITY ZINC CHLORIDE ELECTROGALVANIZING PROCESS AND COMPOSITION

BACKGROUND OF THE INVENTION

1. Field of the Invention

The field of the invention is compositions of matter used as additives to high current density zinc chloride electroplating baths, and processes utilizing such composition for reducing high current density dendrite formation and edge burn, controlling high current density roughness, grain size, and crystallographic orientation of a zinc coating obtained from the bath.

2. Description of Related Art

Zinc corrosion resistant coatings which are electrolytically applied to ferrous metals such as steel are used extensively in industries where corrosion resistance is required, such as the automotive industry.

Zinc offers sacrificial protection to ferrous metals because it is anodic to the substrate which is protected so long as some zinc remains in the area to be protected. The presence of minor pin holes or discontinuities in the deposit is of little significance. Zinc is plated continuously in most industrial processes such as the electrogalvanic coating of continuous steel substrates employed in the automotive and tubular steel industries. Acid chloride and sulfate baths are used extensively because they are capable of higher plating speeds than cyanide coating baths.

They have also displaced cyanide baths because of EPA regulations requiring the reduction or-elimination of cyanide in effluents. The chloride baths include neutral chloride baths containing ammonium ions and chelating agents and acid chloride baths having a pH of from about 3.0 to about 5.5 that substitute potassium ions for the ammonium ions used in the neutral baths. Acid baths have largely replaced neutral ones in practice.

The ASTM specification for zinc deposits on ferrous metals call for thicknesses of from about 5 to about 25 μm, depending on the severity of the expected service. *ASTMB633-78, Specification For Electrodeposited Coatings Of Zinc On Iron and Steel.*

Zinc is deposited from aqueous solutions by virtue of a high hydrogen over voltage since hydrogen would be preferentially deposited under equilibrium conditions.

Typical plating tanks employed in these processes contain anywhere from about 50,000 to about 300,000 gallons and can be employed for plating either zinc or a zinc alloy such as a zinc-iron alloy. These are continuous plating baths which will accommodate steel rolls about 8 feet in diameter at speeds of anywhere from about 200 to about 850 feet per minute with varying coating weights of from about 20 to about 80 grams/$m^2$ and coating thicknesses from about 6 to about 10 μm. The solution flow rate is about 0.5 to about 5 m/sec.

The steel is drawn over conductive rolls to provide adequate contact and prevent the coating solution from reaching the roll. Zinc anodes are immersed in the baths adjacent the coating rolls. In the case of zinc-iron alloy plating operations, separate iron anodes are added to the system.

Excess buildup of zinc at high current densities, however, can occur. If a relatively narrow steel strip is being coated, there may be excess anodes in the system. It is impossible to remove the excess anodes because the next strip to be coated may be larger in size. Because of the mechanics of the line, it is too cumbersome to remove and add anodes to accommodate the size of the different substrates being plated. Current densities of about 50 to about 150 A/$dm^2$ (400–1,500 ASF) are employed which also contribute to the excess buildup of zinc on edge of the plated steel. Allowances for such high current density plating are made by adjusting the solution conductivity, providing close anode-cathode spacing, and providing a high solution flow rate.

Another major concern is that high current density [HCD] produces roughness in the form of dendrites at the edge of the steel strip that is being coated. These dendritic deposits may break off during plating or rinsing. As the electrogalvanized steel is passed over rollers, these loose dendrites become embedded across the coated substrate and subsequently show up as blemishes which are referred to as zinc-pickups. The edges of the steel strip that are coated are also non-uniform in thickness, and burned because of HCD processing. Additionally, HCD processes can cause roughness across the width of the steel strip and change the grain size and crystallographic orientation of the zinc coating. Nonetheless, HCD processes are industrially desirable since production speed is directly related to current density i.e., higher coating line speeds can be obtained at higher current densities.

Accordingly, various grain refiners [GR] and antidendritic agents [ADA] are employed to partially offset these problems. Nonetheless, the problems of edge roughness, non-uniform thickness, and edge burn have not been completely overcome and as a result, most industrial processes require that the edges be trimmed from the steel strip after it is coated. Diamond knives are presently used to trim the edges. Other mechanical means may also be employed to remove excessive zinc buildup. The GR and ADA additives also do not completely eliminate problems with HCD roughness, grain size and orientation of the zinc coating.

It has been found with some of the standard GR or ADA materials that the steel strips exhibit considerable HCD burning at lower additive concentrations whereas nodularity or HCD roughness is still seen at higher concentrations.

The surface roughness of the coated steel strip is expressed in "Ra" units whereas the degree of roughness is expressed in "PPI" units or peaks per inch. These parameters are important in that surface roughness promotes paint adhesion and proper PPI values promote retention of oil which is important during forming operations for zinc coated steel that is used in the manufacture of automobile parts or other parts that are subsequently press formed. A rule of thumb is that the Ra and PPI values should be close to that of the substrate. In some instances it is better to have a zinc coating that is rougher than the substrate rather than smoother, and sometimes smoother than the substrate (i.e., slightly less rough than that of the substrate). Accordingly, the Ra value generally should not exceed about 40 micro inches and the PPI value should be anywhere from about 150 to about 225.

A composition has been used to obtain some of these advantages, and is based on an ethylene oxide polymer having a molecular weight of 600 in combination with equal parts of an antidendritic agent which comprises a sulfonated condensation product of naphthalene and formaldehyde. When employing this combination in these proportions, however, it was found that the zinc coating substantially replicated the surface roughness (Ra) and degree of roughness (PPI) of the steel substrate to which the zinc coating was applied. Zinc coatings having a smoother surface than the substrate could not be obtained.

Additionally, it has been found that various crystallographic orientations of the electrodeposited zinc [(002), (110), (102), (100), (101), and (103)] are obtained, but that with some compositions the (101) orientation is favored.

As noted, production speed can be increased as current density increases and where current densities presently being employed by industry are at about 1,000 ASF (110 A/dm$^2$) current densities of anywhere from about 1,500 to about 3,000 ASF are being explored in order to obtain higher production rates. Operating at these higher current densities has resulted in unacceptable edge burn, dendritic formation and break off, grain size, problems with obtaining or retention of the (101) orientation, and unacceptable values for Ra and PPI.

Additionally, many of the additives to the plating bath employed at about 1,000 ASF do not adequately address the foregoing difficulties.

Pilavov, Russian Patent 1,606,539 describes weekly acidic baths for electrogalvanizing steel containing a condensation copolymer of formaldehyde and 1,5- and 1,8-aminonaphthylalene-sulfonic acid prepared in monoethanolamine. The galvanized steel shows a smaller decrease in ductility compared to that obtained from a conventional bath.

Watanabe et al., U.S. Pat. No. 4,877,497 describe an acidic aqueous electrogalvanizing solution containing zinc chloride, ammonium chloride or potassium chloride and a saturated carboxylic acid sodium or potassium salt. The composition inhibits production of anode sludge.

Tsuchida et al., U.S. Pat. No. 4,581,110 describe a method for electroplating a zinc-iron alloy from an alkaline bath containing iron solubilized with a chelating agent.

Strom et al., U.S. Pat. No. 4,515,663 disclose an aqueous acid electroplating solution for depositing zinc and zinc alloys which contains a comparatively low concentration of boric acid and a polyhydroxy additive containing at least three hydroxyl groups and at least four carbon atoms.

Paneccasio, U.S. Pat. No. 4,512,856 discloses zinc plating solutions and methods utilizing ethoxylated/propoxylated polyhydric alcohols as a novel grain-refining agent.

Kohl, U.S. Pat. No. 4,379,738 discloses a composition for electroplating zinc from a bath containing antidendritic additives based on phthalic anhydride derived compounds and analogs thereof in combination with polyethoxyalkylphenols.

Arcilesi, U.S. Pat. No. 4,137,133 discloses an acid zinc electroplating process and composition containing as cooperating additives, at least one bath soluble substituted or unsubstituted polyether, at least one aliphatic unsaturated acid containing an aromatic or heteroaromatic group and at least one aromatic or N-heteroaromatic aldehyde.

Hildering et al., U.S. Pat. No. 3,960,677 describe an acid zinc electroplating bath which includes a carboxy terminated anionic wetting agent and a heterocyclic brightener compound based on furans, thiophenes and thiazoles.

Dubrow et al., U.S. Pat. No. 3,957,595 describe zinc electroplating baths which contain a polyquaternary ammonium salt and a monomeric quaternary salt to improve throwing power.

SUMMARY OF INVENTION

Accordingly, the present invention is directed to a process and composition that substantially obviates one or more of these and other problems due to limitations and disadvantages of the related art.

These and other advantages are obtained according to the present invention which is the provision of a process and composition of matter that substantially obviates one or more of the limitations and disadvantages of the described prior processes and compositions of matter.

Additional features and advantages of the invention will be set forth in the description which follows, and in part will be apparent from the description, or may be learned by practice of the invention. The objectives and other advantages of the invention will be realized and obtained by the process and composition of matter, particularly pointed out in the written description and claims hereof.

To achieve these and other advantages and in accordance with the purpose of the invention, as embodied and broadly described, the invention comprises a high current density electrogalvanizing process and composition of matter for reducing high current density dendrite formation and edge burn and controlling high current density roughness, grain size and orientation of a zinc coating obtained from a zinc halide aqueous acidic electrogalvanic coating bath. The latter will be referred to herein as such or as the bath or coating bath, unless otherwise indicated.

The process is conducted by adding to the bath a composition of matter comprising a low molecular weight polyoxyalkylene glycol based on 3 to about 4 carbon atom alkylene oxides as a grain refining agent, and a sulfonated condensation product of naphthalene and formaldehyde which acts as an antidendritic agent. A current is passed from a zinc anode in the bath to a metal cathode in the bath for a period of time sufficient to deposit a zinc coating on the cathode. High current density or HCD as referred to in this aspect of the invention is intended to include currents of from about 50 to about 4,000 ASF or higher or from about 100 to about 3,500 ASF, and particularly from about 300 to about 3,000 ASF and especially from about 1,000 to about 3,000 ASF.

The low molecular weight polyoxyalkylene glycol based on 3 to about 4 carbon atom alkylene oxides includes the homopolymers or copolymers thereof with each other and/or ethylene oxide. The copolymers may be random or block copolymers, where the repeating units of the block copolymers are block or heteric or the various combinations of these repeating units known in the art. The low molecular weight polyoxyalkylene glycol in this regard is one that has a molecular weight from about 300 to about 1,100 and especially from about 325 to about 800 and preferably from about 350 to about 550. Those having an average molecular weight of about 425 are especially useful.

Homopolymers and copolymers based on propylene oxide are preferred, especially homopolymers based on propylene oxide, such as for example, polypropylene glycol 425.

In another aspect of the invention, the process is conducted using a composition of matter comprising a glycol compound comprising a high molecular weight polyoxyalkylene glycol; a depolarizer such as an aniline compound; and a carbamate compound comprising a di-lower alkyl dithio carbamyl lower alkyl sulfonic acid, where the lower alkyl group contains from 1 to about 4 carbon atoms and includes aliphatic alkyl groups as well as isomers thereof such as isopropyl or t-butyl, or i-butyl moieties, and the like. This composition of matter may also contain an aldehyde, a grain refiner, or an antidendritic agent, or any combination thereof. The grain refiner in one embodiment comprises a low molecular weight polyoxyalkylene glycol homopolymer or copolymer based on 2 to about 4 carbon atom alkylene oxides, wherein the homopolymer or copolymer has a molecular weight of from about 570 to about 630, and especially one having an average molecular weight of about 600. Homopolymers or copolymers based on ethylene oxide are preferred, especially homopolymers based on ethylene oxide. The antidendritic agent comprises a sulfonated condensation product of naphthalene and formaldehyde.

In a further embodiment of the invention, it has been found in a composition of matter comprising equal parts of an antidendritic agent and a grain refining agent, that by increasing the antidendritic agent and keeping the grain refining agent constant (i.e. increasing the amount of the antidendritic agent, so that it is greater than the grain refining agent, on a weight basis), that the HCD zinc coatings applied according to the process described herein will be smoother, in that they will not be as rough as the steel substrate to which they are applied i.e. they will have lower Ra and PPI values than the steel substrate. The antidendritic agent in this regard comprises a sulfonated condensation product of naphthalene and formaldehyde and the grain refining agent comprises a low molecular weight polyoxyalkylene glycol homopolymer or copolymer based on 2 to about 4 carbon atom alkylene oxides, especially homopolymers or copolymers based on ethylene oxide, wherein the homopolymer or copolymer has a molecular weight of from about 570 to about 630, and especially one having an average molecular weight of about 600.

The molecular weight or average molecular weight of the cols as those terms are employed herein refers to the weight average molecular weight.

DETAILED DESCRIPTION

The zinc halide electrogalvanic coating baths that may be employed with the compositions of, and according to the processes of the present invention generally comprise a mixture of anywhere from about 0.75 to about 3.0 moles, and especially from about 1.25 to about 1.75 moles of a zinc halide per liter of solution and from about 5.5 to about 11 moles and especially from about 7.0 to about 9.5 moles of an alkali metal halide per liter of solution. The halide is preferably a chloride although fluorides, bromides and iodides can be used including mixtures of halides and especially the two component or three component mixtures. The alkali metal may be any one of the Group IA metals or mixtures thereof and particularly sodium or potassium and preferably potassium.

The pH of the bath may be anywhere from about 3 to about 5.5 and especially from about 4.0 to about 5.0. Halogen acids may be added to the bath in order to adjust the pH. These acids include hydrofluoric, hydrochloric, hydrobromic and hydriodic acids or any mixture thereof and especially the two component or three component mixtures. Hydrochloric acid is preferred.

The bath is operated at a temperature of from about 120° F. to about 160° F., and especially from about 130° F. to about 140° F.

The electrogalvanizing process is carried out under conditions and in the manner heretofore described for coating a metal substrate and especially a steel substrate by passing a current from a zinc anode immersed in the electrogalvanic coating bath to a metal cathode in the bath for a period of time sufficient to deposit a zinc coating on the cathode.

The composition of matter of the invention is added to the bath for reducing high current density dendrite formation and edge burn and controlling high current density roughness (Ra and PPI), grain size and orientation of the zinc coating obtained, and can be one of three formulations.

The first formulation (Formulation 1) is a composition of matter comprising a low molecular weight polyoxyalkylene glycol based on 3 to about 4 carbon atom alkylene oxides as described herein and used as a grain refining agent, and a sulfonated condensation product of naphthalene and formaldehyde which is used as an antidendritic agent.

The second formulation (Formulation 2) is a composition of matter comprising a glycol compound, which is a high molecular weight polyoxyalkylene glycol; and a carbamate compound comprising a di-lower alkyl dithio carbamyl lower alkyl sulfonic acid, where the lower alkyl group contains from 1 to about 4 carbon atoms and includes aliphatic alkyl groups as well as isomers thereof such as isopropyl or t-butyl, or i-butyl moieties, and the like. Optionally, a depolarizer such as an aniline compound; a low molecular weight polyoxyalkylene glycol grain refining agent; or a sulfonated condensation product of naphthalene and formaldehyde as an antidendritic agent may also be added.

The third formulation, (Formulation 3), comprises an antidendritic agent comprising a sulfonated condensation product of naphthalene and formaldehyde in combination with a grain refining agent, where the antidendritic agent is used in an amount greater than the grain refining agent. The grain refining agent comprises a low molecular weight polyoxyalkylene glycol homopolymer or copolymer based on 2 to about 4 carbon atom alkylene oxides, especially homopolymers or copolymers based on ethylene oxide, wherein the homopolymer or copolymer has a molecular weight of from about 570 to about 630, and especially one having an average molecular weight of about 600. Homopolymers of ethylene oxide are especially preferred.

It has been found by increasing the antidendritic agent and keeping the grain refining agent constant (i.e. increasing the amount of the antidendritic agent, so that it is greater than the grain refining agent, on a weight basis), that the HCD zinc coatings applied according to the process described herein will be smoother, in that they will not be as rough as the steel substrate to which they are applied i.e. they will have lower Ra and PPI values than the steel substrate.

In Formulations 1, 2 or 3, water soluble boron oxide compounds may also be added to further reduce high current density edge burn and dendrite formation. A lignin composition of matter may also be added as a brightener.

The polyoxyalkylene glycols of the present invention as used in Formulations 1, 2 or 3 are preferably water soluble at operating temperatures and may be polyoxyalkylene glycol ether all-block, block-heteric, heteric-block or heteric-heteric block copolymers where the alkylene units have from 2 to about 4 carbon atoms and may comprise surfactants which contain hydrophobic and hydrophilic blocks where each block is based on at least oxyethylene groups or oxypropylene groups or mixtures of these groups. Mixtures of homopolymers and copolymers may also be used, especially the 2 or 3 component mixtures.

Of the various polyether-polyol block-copolymers available, the preferred materials comprise polyoxyalkylene glycol ethers which in the case of surfactants contain hydrophobic and hydrophilic blocks, each block preferably being based on at least oxyethylene groups or oxypropylene groups or mixtures of these groups.

The most common method of obtaining these materials is by reacting an alkylene oxide such as ethylene oxide with a material that contains at least one reactive hydrogen. Alternative routes include the reaction of the active hydrogen material with a preformed polyglycol or the use of ethylene chlorohydrin instead of an alkylene oxide.

The reacting active hydrogen material must contain at least one active hydrogen preferably alcohols, and optionally acids, amides, mercaptans, alkyl phenols and the like. Primary amines can be used as well.

Especially preferred materials are those obtained by block polymerization techniques. By the careful control of monomer feed and reaction conditions, a series of compounds, e.g., surfactants can be prepared in which such characteristics as the hydrophile-lipophile balance (HLB), wetting and foaming power can be closely and reproducibly controlled. The chemical nature of the initial component employed in the formation of the initial polymer block generally determines the classification of the materials. The initial component does not have to be hydrophobic. In the case of surfactants, hydrophobicity will be derived from one of the two polymer blocks. The chemical nature of the initial component in the formation of the first polymer block generally determines the classification of the materials. Typical starting materials or initial components include monohydric alcohols such as methanol, ethanol, propanol, butanol and the like as well as dihydric materials such as glycol, glycerol, higher polyols, ethylene diamine and the like.

The various classes of materials, suitable for practice of this aspect of the present invention that are surfactants, have been described by Schmolka in "Non-Ionic Surfactants," Surfactant Science Series Vol. 2, Schick, M. J., Ed. Marcel Dekker, Inc., New York, 1967, Chapter 10 which is incorporated herein by reference.

The first and simplest copolymer is that in which each block is homogeneous which is to say a single alkylene oxide is used in the monomer feed during each step in the preparation. These materials are referred to as all-block copolymers. The next classes are termed block-heteric and heteric-block, in which one portion of the molecule is composed of a single alkylene oxide while the other is a mixture of two or more such materials, one of which may be the same as that of the homogeneous block portion of the molecule. In the preparation of such materials, the hetero portion of the molecule will be totally random. The properties of these copolymers will be entirely distinct from those of the pure block copolymers. The other class is that in which both steps in the preparation of the different repeating units involve the addition of mixtures of alkylene oxides and is defined as a heteric-heteric block copolymer.

The block copolymer is typified by a monofunctional starting material such as a monohydric alcohol, acid, mercaptan, secondary amine or N-substituted amides. These materials can generally be illustrated by the following formula:

$$I—[A_m—B_n]_x \quad (1)$$

where I is the starting material molecule as described before. The A portion is a repeating unit comprising an alkylene oxide unit in which at least one hydrogen can be replaced by an alkyl group or an aryl group, and m is the degree of polymerization which is usually greater than about 6. The B moiety is the other repeating unit such as oxyethylene with n again being the degree of polymerization. The value of x is the functionality of I. Thus, where I is a monofunctional alcohol or amine, x is 1; where I is a polyfunctional starting material such as a diol (e.g., propylene glycol), x is 2 as is the case with the Pluronic® surfactants. Where I is a tetrafunctional starting material such as ethylenediamine, x will be 4 as is the case with Tetronic® surfactants. Preferred copolymers of this type are the polyoxypropylene-polyoxyethylene block copolymers.

Multifunctional starting materials may also be employed to prepare the homogeneous block copolymers.

In the block-heteric and heteric-block materials either A or B will be a mixture of oxides with the remaining block being a homogeneous block. Where the copolymer is a surfactant, one block will be the hydrophobe and the other the hydrophile and either of the two polymeric units will serve as the water solubilizing unit but the characteristics will differ depending on which is employed. Multifunctional starting materials can also be employed in materials of this type.

The heteric-heteric block copolymers are prepared essentially the same way as discussed previously with the major difference being that the monomer feed for the alkylene oxide in each step is composed of a mixture of two or more materials. The blocks will therefore be random copolymers of the monomer feed. In the case of surfactants, the solubility characteristics will be determined by the relative ratios of potentially water soluble and water insoluble materials.

The average molecular weight of the polyoxyalkylene glycol ether block copolymers of Formulation 1 based on 3 to about 4 carbon atom alkylene oxides is from about 300 to about 1,000 and especially those having an average molecular weight of about 425. These copolymers, as represented by formula (1) are prepared so that the weight ratio of A to B repeating units will also vary from about 0.4:1 to about 2.5:1, especially from about 0.6:1 to about 1.8:1 and preferably from about 0.8:1 to about 1.2:1.

In one embodiment, these copolymers of Formulation 1 have the general formula:

$$RX(CH_2CH_2[CH_2]_yO)_nH \quad (2)$$

where R has an average molecular weight of from about 200 to about 900, especially from about 300 to about 850 and especially from about 350 to about 400, and where R is usually a typical surfactant hydrophobic group but may also be a polyether such as a polyoxyethylene group, a polyoxypropylene group, or a polyoxybutylene group, or a mixture of polyoxypropylene, polyoxyethylene and polyoxypropylene groups. In the above formula is either oxygen or nitrogen or another functionality capable of linking the polyoxyalkylene chain to R, and y has a value of 0, 1, or 2. In most cases, n, the average number of alkylene oxide units must be greater than about 5 or about 6. This is especially the case where it is desired to impart sufficient water solubility to make the materials useful.

The high molecular weight polyoxyalkylene glycol ether block copolymers of Formulation 2 utilized according to the present invention are those that may have a molecular weight of from about 2,000 to about 9,500 especially from about 2,000 to about 8,500. The weight ratio of A to B repeating units will also vary from about 0.4:1 to about 2.5:1, especially from about 0.6:1 to about 1.8:1 and preferably from about 0.8:1 to about 1.2:1.

In one embodiment, these copolymers have the general formula:

$$RX(CH_2CH_2O)_nH \quad (3)$$

where R has an average molecular weight of from about 500 to about 8,000, especially from about 1,000 to about 6,000 and preferably from about 1,200 to about 5,000 for the high molecular weight polyoxyalkylene glycol of Formulation 2. The value for R of the low molecular weight polyoxyalkylene glycols employed in Formulation 2 is from about 200 to about 600, and especially from about 300 to about 500. R is usually a typical surfactant hydrophobic group but may also be a polyether such as a polyoxyethylene group, a polyoxypropylene group, a polyoxybutylene group, or a mixture of these groups. In the above formula X is either oxygen or nitrogen or another functionality capable of linking the polyoxyethylene chain to R. In most cases, n, the average number of oxyethylene units in the oxyethylene group, must be greater than about 5 or about 6. This is especially the case where it is desired to impart sufficient water solubility to make the materials useful.

The preferred polyoxyalkylene glycol ethers are the non-ionic polyether-polyol block-copolymers. However, other non-ionic block-coplymers useful in the invention can be modified block copolymers using the following as starting materials: (a) alcohols, (b) fatty acids, (c) alkylphenol derivatives, (d) glycerol and its derivatives, (e) fatty amines, (f)-1,4-sorbitan derivatives, (g) castor oil and derivatives, and (h) glycol derivatives.

Formulation 1

In Formulation 1, the low molecular weight polyoxyalkylene glycol based on 3 to about 4 carbon atom alkylene oxides used as a grain refining agent may be employed in an amount anywhere from about 0.025 to about 0.5 gms/liter and especially from about 0.05 to about 0.15 gms/liter. The sulfonated condensation product of naphthalene and formaldehyde used as an antidendritic agent is employed in an amount anywhere from about 0.025 to about 1.0 gms/liter and especially from about 0.05 to about 0.5 gms/liter.

The preferred low molecular weight polyoxyalkylene glycol based on 3 to about 4 carbon atom alkylene oxides are homopolymers or copolymers of these alkylene oxides. Propylene oxide polymers are especially preferred in this regard.

The foregoing quantities comprise the quantities of the various components of the composition of matter after their addition to the electrogalvanic coating bath. When this composition of matter is added to this coating bath, it is preferably added as a solution or dispersion in a liquid, preferably water, so that the composition is present in the coating bath in an amount from about 25 to about 1000 ppm and especially from about 50 to about 250 ppm by volume, based on the volume of the coating bath.

As used throughout the specification, the term "ppm" will mean parts per million, on a volume basis, based on the volume of the coating bath, unless indicated otherwise.

The preferred sulfonated condensation product of naphthalene and formaldehyde used as an antidendritic agent comprises BLANCOL®-N. It has been found that Formulation 1 is especially effective in reducing dendrite formation and edge burn at high current densities as defined herein and especially at from about 1500 to about 3000 ASF.

The formulation was evaluated in a plating cell containing a zinc halide solution as follows:

Zn 80-100 gms/liter $Cl^-$ about 300 gms/liter as $Cl^-$ pH 4.5; 60° C.; 1000–3000 ASF Solution Flow: 1–3 m/sec Anode:Cathode Spacing: About 2 cm.

Formulation 1 showed significant reduction in edge burn at these coating conditions and little, if any, dendrites were observed at 50× and 100× magnification of these samples obtained.

Formulation 2

In Formulation 2, the high molecular weight glycol compound may be present in an amount anywhere from about 0.5 to about 2.0 gms/liter and especially from about 1.0 to about 1.5 gms/liter whereas the depolarizer or aniline compound is present in an amount from about 0.001% to about 0.02% and especially from about 0.005 to about 0.01% by volume, based on the volume of the coating bath. The carbamate compound is present in an amount from about 0.005 to about 0.05 gms/liter and especially from about 0.01 to about 0.03 gms/liter. The low molecular weight polyoxyalkylene glycol grain refining agent may be present in an amount from about 0.025 to about 0.5 gms/liter and especially from about 0.075 to about 0.2 gms/liter.

The foregoing quantities of Formulation 2 comprise the quantities of the various components of the composition of matter after their addition to the electrogalvanic coating bath. When this composition of matter is added to this coating bath, it is preferably added as a solution or dispersion in a liquid, preferably water, so that the composition is present in the coating bath in an amount from about 0.1 to about 1.0 and especially from about 0.3 to about 0.7 parts by volume of the coating bath.

The high molecular weight glycol compound that is employed preferably comprises an ethylene oxide polymer and especially an ethylene oxide polymer having a molecular weight of from about 2,000 to about 9,500 especially about 2,000 to about 8,500, and preferably an ethylene oxide polymer having an average molecular weight of about 8,000. These compounds include Carbowax® PEG 4:000 (molec. wt. 3,000–3,700) PEG 6000 (molec. wt. 6,000–7,500) and PEG 8000 sold by Union Carbide Corporation.

The aniline compound used as a depolarizer in the composition of matter preferably comprises a mono or di-lower alkyl aniline where the lower alkyl group contains from 1 to about 4 carbon atoms and includes aliphatic alkyl groups as well as isomers thereof such as isopropyl or t-butyl, or i-butyl moieties, and the like. Dimethyl aniline is especially preferred.

Other aniline compounds that may be used including those that are mono or di-substituted at the amino position, are acetyl aniline, allylaniline, aminoaniline, aminodimethylaniline, benzalaniline, benzilideneaniline, benzoylaniline, benzylaniline, bianiline, bromoaniline, diacetylaniline, dibenzylaniline, dichloroaniline, dimethylaniline, dimethylaminoaniline, dinitroaniline, diphenylaniline, ethoxyaniline, ethylaniline, formylaniline, hydroxyaniline, iodoaniline, isopropylaniline, methenyltrianiline, methoxyaniline, N-methylaniline, nitrosoaniline, p-nitrosodiethylaniline, p-nitrosodimethylaniline, pentachloraniline, phenylaniline, propionylaniline, thioaniline, thionylaniline, tribromoaniline and trimethylaniline. Water-soluble aniline compounds are especially preferred.

The carbamate compound comprises a di-lower alkyl dithio carbamyl lower alkyl sulfonic acid where the lower alkyl groups contain from 1 to about 4 carbon atoms and include the aliphatic and branched chain aliphatic lower alkyl groups. A preferred carbamate comprises dimethyl dithio carbamyl propyl sulfonic acid (also referred to as N,N-dimethyl-dithio-carbamate-3-sulfopropyl ester sodium salt).

The foregoing composition may optionally contain an aldehyde in an amount anywhere from 0 to about 0.01% gms and especially from about 0.002 to about 0.006% by weight of the solution. Aliphatic saturated or unsaturated monoaldehydes or dialdehydes having from 1 to about 6 carbon atoms or an aromatic aldehyde having from 7 to about 15 carbon atoms can be used in this regard.

Formaldehyde is often used because of its ready availability. In addition to formaldehyde the aliphatic saturated aldehydes that may also be employed include acetaldehyde, propionaldehyde, butyraldehyde, valeraldehyde, and caproaldehyde.

Aliphatic unsaturated aldehydes may be used to include acrolein, crotonaldehyde, tiglicaldehyde, and propionaldehyde.

The various aliphatic dialdehydes that may be employed include glyoxal, succinaldehyde and adpialdehyde.

The various aromatic aldehydes that are useful according to the present invention include benzaldehyde, tolualdehyde, cinnamaldehyde, salicylaldehyde, anisaldehyde, naphthaldehyde and anthraldehyde.

Water-soluble aldehydes are especially preferred.

Especially good results have been obtained employing Formulation 2 with an antidendritic agent comprising a sulfonated condensation product of naphthalene and formaldehyde. This composition is sold under the trade name of BLANCOL®-N. This antidendritic agent may be employed in an amount anywhere from about 0.025 to about 0..5 gms/liter and especially from about 0.05 to about 0.2 gms/liter, but in any event in an amount so that it will be present in the bath at from about 25 to about 500 ppm and especially from about 75 to about 150 ppm.

Formulation 2 can also include a grain refining agent such as a low molecular weight polyoxyalkylene glycol homopolymer or copolymer, based on alkylene oxides having anywhere from 2 to about 4 carbon atoms and especially ethylene oxide polymer homopolymers and copolymers, such as those having a molecular weight from about 570 to about 630 and especially an ethylene oxide polymer having an average molecular weight of about 600. This ethylene oxide polymer can be used in Formulation 2 in an amount from about 0.025 to about 0.5 gms/liter and especially from about 0.075 to about 0.2 gms/liter. As with the antidendritic agent, the amount of the low molecular weight ethylene oxide polymer should be present so that when the composition is added to the bath, the ethylene oxide polymer grain refining agent will be present in an amount anywhere from about 25 to about 500 ppm and especially from about 75 to about 200 ppm based on the volume of the coating bath.

In a preferred embodiment, Formulation 2 includes both the antidendritic agent and the grain refining agent in a ratio from about 0.25 parts by weight of antidendritic agent to about 4.0 parts by weight of grain refining agent and especially from about 0.5 parts by weight of antidendritic agent to about 2.0 parts by weight of grain refining agent.

Coatings of Formulation 2 were evaluated in a plating cell employing the following conditions:

Zn 80–100 gms/liter $Cl^-$ 300 gms/liter about 300 gms/liter as $Cl^-$ pH 4.5; 60° C.; 100 A/dm$^2$ Solution Flow: 1–3 m/sec Anode:Cathode Spacing: About 1 cm Formulation 2 was as follows:

| | |
|---|---|
| Carbowax ® 8,000 | 66.0 gms/liter |
| Dimethylaniline | 3.3 gms/liter |
| Dimethyl dithio carbamyl propyl sulfonic acid | 1.0 gms/liter |
| Grain refining agent | 20.0 gms/liter |

-continued

| | |
|---|---|
| BLANCOL ®-N Antidendritic agent | 20.0 gms/liter |
| Formaldehyde | 2.5 gms/liter |

Formulation 2 was added in amount of 5 ml/liter based on the volume of the solution.

The grain refining agent comprised ethylene oxide polymer having an average molecular weight of about 600 and the antidendritic agent comprised BLANCOL®-N, a sulfonated condensation product of naphthalene and formaldehyde.

A steel substrate was coated in the plating cell and surface roughness (Ra) and peaks per inch (PPI) were measured. The results are reported in Table 1.

Formulation 2 was added to the plating cell in varying concentrations with and without the grain refiner and the antidendritic agent. The grain refiner and antidendritic agent were also varied.

Formulation 2 in conjunction with the grain refining agent and the antidendritic agent reduced HCD roughness and increased the operating window for the grain refining and antidendritic agent concentrations and minimized surface roughness, grain size and orientation.

TABLE 1

FLOW CELL EVALUATION
Surface Roughness and Peaks Per Inch

| Form. 2 (ml/l) | GR/ADA(1) (ml/l) | | | |
|---|---|---|---|---|
| i = 600 ASF, 500 fpm, 140° F., Ra/PPI VALUES | | | | |
| 0 | 0 | 0.75/1.5 | 1.5/1.5 | 3.75/1.5 |
| 1 | 128/256 | 25/101 | 26/135 | 23/105 |
| 5 | 109/120 | 29/145 | 31/165 | 28/133 |
| 8 | 100/246 | 30/177 | 28/178 | 29/157 |
| 12 | — | 26/186 | 31/165 | 31/144 |
| i = 900 ASF, 500 fpm, 140° F., Ra/PPI VALUES | | | | |
| 0 | 0 | 0.75/1.5 | 1.5/1.5 | 3.75/1.5 |
| 1 | 107/298 | 29/143 | 30/156 | 28/153 |
| 5 | 117/251 | 33/197 | 31/203 | 35/170 |
| 8 | 116/272 | 32/182 | 40/156 | 36/187 |
| 12 | — | 30/205 | 36/192 | 25/191 |
| i = 1500 ASF, 500 fpm, 140° F., Ra/PPI VALUES | | | | |
| 0 | 0 | 0.75/1.5 | 1.5/1.5 | 3.75/1.5 |
| 1 | 110/300 | 26/118 | 33/155 | 41/219 |
| 5 | 113/310 | 31/174 | 35/165 | 45/257 |
| 8 | 108/293 | 35/180 | 38/206 | 48/292 |
| 12 | — | 37/187 | 39/217 | 49/304 |

(1) Grain Refiner/Antidendritic Agent

Table 1 shows surface roughness increases sharply in deposits plated from the solution containing only Formulation 2. With a nominal amount of grain refiner and antidendritic agent in solution, Ra and PPI values decrease to acceptable values. With a ratio of grain refiner to antidendritic agent of 0.5, Formulation is best utilized at about 5 mL/L to produce deposits with Ra and PPI values suitable for the automotive industry.

Slightly lower concentrations of Formulation 2 can be used at higher current densities. Grain refiner and antidendritic agent ratios of 1:1 produced acceptable deposits at a Formulation 2 concentration of 5 mL/L. At higher current densities, too much of Formulation 2 produced rough deposits. At high grain refiner and nominal antidendritic agent ratios of 2.5:1 smaller amounts of Formulation 2 are required.

It was also shown that Formulation 2 does not affect plating rate to any great extent in that coating thicknesses of approximately 8 μm are obtained in the allotted time at 900 and 1,500 ASF. SEM analysis of deposits plated from solutions with only Formulation 2 produced large grains of 2–6 μm. It was determined, however, that increased grain refiner concentrations and high current densities will change the structure. In addition, edge roughness is still severe at low Formulation 2 concentrations. Slightly less edge roughness was also obtained at higher Formulation 2 concentrations.

It was also determined by X-ray diffraction analysis that Formulation 2 without the grain refiner or antidendritic agent produces the desired (101) orientation of the zinc coating on the steel substrate. Increasing the current density has only a small change in the observed reflections.

Formulation 3

In a further embodiment of the invention, it has been found that by increasing the antidendritic agent and keeping the grain refining agent constant (i.e. increasing the amount of the antidendritic agent, so that it is greater than the grain refining agent, on a weight basis), that the HCD zinc coatings applied according to the process described herein will be smoother, in that they will not be as rough as the steel substrate to which they are applied i.e. they will have lower Ra and PPI values than the steel substrate.

Especially good results have been obtained employing Formulation 3 with an antidendritic agent comprising a sulfonated condensation product of naphthalene and formaldehyde. This composition is sold under the trade name of BLANCOL®-N. This antidendritic agent may be employed in an amount anywhere from about 0.025 to about 0.5 gms/liter and especially from about 0.05 to about 0.2 gms/liter, but in any event in an amount so that it will be present in the bath at from about 25 to about 600 ppm and especially from about 45 to about 450 ppm, but in any event from about 1.2 to about 15 times, and especially from about 1.3 to about 10 times the amount of grain refining agent employed in the bath.

Formulation 3 includes a grain refining agent comprising a low molecular weight polyoxyalkylene glycol homopolymer or copolymer, based on alkylene oxides having anywhere from 2 to about 4 carbon atoms and especially ethylene oxide polymer homopolymers and copolymers, such as those having a molecular weight from about 570 to about 630 and especially an ethylene oxide polymer having an average molecular weight of about 600. This ethylene oxide polymer is used in Formulation 3 in an amount from about 0.025 to about 0.5 gms/liter and especially from about 0.075 to about 0.2 gms/liter. The amount of the low molecular weight ethylene oxide polymer should be present so that when the composition is added to the bath, the ethylene oxide polymer grain refining agent will be present in an amount anywhere from about 25 ppm to about 500 ppm and especially from about 75 ppm to about 200 ppm based on the volume of the coating, so long as it is employed in the bath in a lesser amount than the antidendritic agent as noted above.

Coatings of Formulation 3 were evaluated in a plating cell employing the following conditions:

Zn 80–100 gms/liter
$Cl^-$ 300 gms/liter;
about 300 gms/liter as $Cl^-$
pH 4.5; 60° C.; 100 A/dm$^2$
Solution Flow: 1–3 m/sec
Anode:Cathode Spacing: About 1 cm Formulation 3 was as follows:

Polyethylene glycol 600 Grain refining agent gms/liter *
BLANCOL®-N Antidendritic agent gms/liter *
* See Table 2

A steel substrate was coated in the plating cell and surface roughness (Ra) and peaks per inch (PPI) were measured. The results are reported in Table 2.

TABLE 2

| | | GR UPPS) ml/l | | | |
|---|---|---|---|---|---|
| ADA | ml/l | 0.63 | 1.21 | 3.10 | 6.20 |
| i = 600 ASF, 500 fpm, 140° F., Ra/PPI VALUES | | | | | |
| 0.63 | (45 ppm) | 28/149 | 28/157 | 26/178 | 23/127 |
| 1.21 | (90 ppm) | 20/128 | 20/123 | 21/92 | 19/73 |
| 3.10 | (225 ppm) | 17/67 | 17/65 | 20/93 | 23/61 |
| 6.20 | (450 ppm) | 19/71 | 30/98 | 24/73 | 18/56 |
| Control: 47/316 | | | | | |
| Substrate: 32/199 | | | | | |
| i = 900 ASF, 500 fpm, 140° F., Ra/PPI VALUES | | | | | |
| 0.63 | (45 ppm) | 32/176 | 31/179 | 32/180 | 31/170 |
| 1.21 | (90 ppm) | 23/127 | 32/160 | 36/147 | 29/151 |
| 3.10 | (225 ppm) | 21/86 | 21/98 | 22/114 | 33/86 |
| 6.20 | (450 ppm) | 18/43 | 25/86 | 24/100 | 24/87 |
| Control: 43/286 | | | | | |
| Substrate: 32/190 | | | | | |
| i = 1500 ASF, 500 fpm, 140° F., Ra/PPI VALUES | | | | | |
| 0.63 | (45 ppm) | 28/118 | 31/190 | 43/231 | 42/208 |
| 1.21 | (90 ppm) | 23/126 | 30/156 | 38/138 | 83/205 |
| 3.10 | (25 ppm) | 20/158 | 26/127 | 29/154 | 29/155 |
| 6.20 | (450 ppm) | 14/45 | 30/139 | 23/113 | 26/110 |
| Control: 48/285 | | | | | |
| Substrate: 32/190 | | | | | |

Formulations 1, 2 or 3 may also include a water-soluble boron oxide compound such as boric acid or an alkali metal borate (where the alkali metals are defined herein) or a fluoroborate including the alkali metal fluoroborates, again where the alkali metals have been defined herein.

The water-soluble boron oxide compound is employed in an amount anywhere from about 10 to about 70 gms/liter and especially from about 30 to about 40 gms/liter of the coating bath.

It has been found that when these boron oxide compounds are employed under the conditions of HCD plating, that there is even less HCD burn than when these boron oxide compounds are not employed. Boric acid is especially suitable in this regard.

In addition, Formulations 1, 2, or 3, may also contain a lignin compound such as vanillin which is an aldehyde derived from lignin. Additionally, lignin sulfate or other lignin salts known in the art may be employed. These lignin compounds are brighteners and are used in those applications where a bright finish is desired.

The lignin compound in Formulations 1, 2, or 3, may be employed in an amount anywhere from about 0.002 to about 0.01 gms/liter and especially from about 0.03 to about 0.05 gms/liter of the coating bath.

Alloys of zinc may also be deposited employing either Formulation 1, Formulation 2 or Formulation 3 as an additive to the coating bath. Iron alloys are the most common alloys of zinc utilized in zinc-type corrosion protection coatings and the preparation of these type of alloy coatings are also within the scope of the present invention. Any of the other Group VIII metals may be used in this regard besides iron, and includes cobalt. Other Group IIB metals may also be plated in this way in addition to zinc or with zinc and include cadmium and mercury. Zinc alloys with Cr and Mn can also be plated. Mixtures of alloying metals from Group VIII and/or Group IIB or Cr or Mn may also be prepared, especially the two component or three component alloys where the alloying metal is present in the coating in an amount anywhere from about 0.2 to about 20 percent by weight and especially from about 5 to about 15 percent by weight.

The alloys are prepared by inserting the alloy metal into the coating baths as an anode in a manner well known in the art. The alloys can also be prepared by adding a salt of the alloying metal to the coating bath.

Although the examples describe the electrogalvanizing process as one that is conducted on a steel substrate, any conductive metal substrate may be employed whether a pure metal or a metal alloy and include other iron-alloy substrates or metals or alloys based on Groups IB, IIB, IIIA, IVA, IVB, VA, VB, VIB or VIIB, the alloys comprising combinations of two or more of these metals and especially the two or three or four component combinations of metals. The alloying metal is present in the substrate in an amount anywhere from about 0.1 to about 30 percent by weight and especially from about 2 to about 20 percent by weight.

It will be apparent to those skilled in the art that various modifications and variations can be made to the composition and process of the invention without departing from the spirit or scope of the invention. It is intended that these modifications and variations of this invention are to be included as part of the invention, provided they come within the scope of the appended claims and their equivalents.

What is claimed is:

1. A process for reducing dendrite formation and edge burn and controlling roughness, grain size and orientation of a zinc coating obtained from a zinc halide aqueous acidic electrogalvanic coating bath operated at a current density of from about 300 to about 3000 amperes per square foot comprising adding to said bath a composition of matter consisting essentially of:

a low molecular weight polyoxyalkylene glycol homopolymer or copolymer based on 3 to about 4 carbon atom alkylene oxides as a grain refining agent, and a sulfonated condensation product of naphthalene and formaldehyde as an antidendritic agent, and passing from about 300 to about 3000 amperes per square foot of current from a zinc anode in said bath to a metal cathode in said bath for a period of time sufficient to deposit a zinc coating on said cathode.

2. The process of claim 1 where said low molecular weight polyoxyalkylene glycol homopolymer or copolymer based on 3 to about 4 carbon atom alkylene oxides has an average molecular weight of from about 300 to about 1,100.

3. The process of claim 2 where said glycol compound comprises a propylene oxide polymer having an average molecular weight of about 425.

4. The process of claim 2 wherein said composition also contains a water-soluble boron oxide compound.

5. The process of claim 2 wherein said composition also contains a lignin compound.

6. A process for reducing dendrite formation and edge burn and controlling roughness, grain size and orientation of a zinc coating obtained from a zinc halide aqueous acidic electrogalvanic coating bath operated at a current density of from about 300 to about 3000 amperes per square foot comprising adding to said bath a composition of matter consisting essentially of:

a glycol compound comprising a high molecular weight-_polyoxyalkylene glycol homopolymer or copolymer, a depolarizer, a carbamate compound comprising a di-lower alkyl dithio carbamyl lower alkyl sulfonic acid, and passing from about 300 to about 3000 amperes per square foot of current from a zinc anode in said bath to a metal cathode in said bath for a period of time sufficient to deposit a zinc coating on said cathode.

7. The process of claim 6, wherein said composition contains an aliphatic saturated or unsaturated monoaldehyde or dialdehyde having from 1 to about 6 carbon atoms or an aromatic aldehyde having from 7 to about 15 carbon atoms.

8. The process of claim 6 where said glycol compound comprises a polyoxyalkylene glycol homopolymer or copolymer having an average molecular weight of from about 2,000 to about 9,500.

9. The process of claim 8 wherein said composition contains an antidendritic agent comprising a sulfonated condensation product of naphthalene and formaldehyde.

10. The process of claim 9 wherein said composition contains a grain refining agent comprising a low molecular weight polyoxyalkylene glycol homopolymer or copolymer.

11. The process of claim 10 where said low molecular weight polyoxyalkylene glycol homopolymer or copolymer has an average molecular weight of from about 570 to about 630.

12. The process of claim 10 where said low molecular weight polyoxyalkylene glycol homopolymer or copolymer comprises an ethylene oxide polymer having an average molecular weight of about 600.

13. The process of claim 12 where said glycol compound comprises an ethylene oxide polymer having an average molecular weight of about 8,000, said depolarizer is an aniline compound comprising a di-lower alkyl aniline, and said carbamate comprises dimethyl dithio carbamyl propyl sulfonic acid.

14. The process of claim 8 wherein said composition contains a grain refining agent comprising a low molecular weight polyoxyalkylene glycol homopolymer or copolymer.

15. The process of claim 14 wherein said low molecular weight polyoxyalkylene glycol homopolymer or copolymer has an average molecular weight of from about 570 to about 630.

16. The process of claim 14 where said low molecular weight polyoxyalkylene glycol homopolymer or copolymer comprises an ethylene oxide polymer having an average molecular weight of about 600.

17. The process of claim 16 where said glycol compound comprises an ethylene oxide polymer having an average molecular weight of about 8,000, said depolarizer is an aniline compound comprising a di-lower alkyl aniline, and said carbamate comprises dimethyl dithio carbamyl propyl sulfonic acid.

18. The process of claim 6 where said glycol compound comprises an ethylene oxide polymer having an average molecular weight of about 8,000, said depolarizer is an aniline compound comprising a di-lower alkyl aniline, and said carbamate comprises dimethyl dithio carbamyl propyl sulfonic acid.

19. The process of claim 6 wherein said composition also contains a water-soluble boron oxide compound.

20. The process of claim 6 wherein said composition also contains a lignin compound.

21. A process for reducing dendrite formation and edge burn and controlling roughness, grain size and orientation of a zinc coating obtained from a zinc halide aqueous acidic electrogalvanic coating bath operated at a current density of from about 300 to about 3000 amperes per square foot comprising adding to said bath a composition of matter consisting essentially of:

a low molecular weight polyoxyalkylene glycol homopolymer or copolymer based on 2 to about 4 carbon atom alkylene oxides as a grain refining agent, and a sulfonated condensation product of naphthalene and formaldehyde as an antidendritic agent, and passing from about 300 to about 3000 amperes per square foot of current from a zinc anode in said bath to a metal cathode in said bath for a period of time sufficient to deposit a zinc coating on said cathode, said grain refining agent being present in an amount greater than said antidendritic agent so that said zinc coating will have a surface smoother than said cathode on which it is being deposited.

22. The process of claim 21 where said low molecular weight polyoxyalkylene glycol homopolymer or copolymer based on 2 to about 4 carbon atom alkylene oxides has an average molecular weight of from about 570 to about 630.

23. The process of claim 22 where said low molecular weight polyoxyalkylene glycol homopolymer or copolymer comprises an ethylene oxide polymer having an average molecular weight of about 600.

24. The process of claim 21 wherein said composition also contains a water-soluble boron oxide compound.

25. The process of claim 21 wherein said composition also contains a lignin compound.

* * * * *

UNITED STATES PATENT AND TRADEMARK OFFICE

CERTIFICATE OF CORRECTION

PATENT NO. : 5,656,148

DATED : August 12, 1997

INVENTOR(S) : Martyak et al.

It is certified that error appears in the above-indentified patent and that said Letters Patent is hereby corrected as shown below:

Claim 6, column 16, lines 1 and 2, "weight-_polyoxyalkylene" should read --weight polyoxyalkylene--.

Signed and Sealed this

Fourteenth Day of October, 1997

*Attest:*

*Attesting Officer*

BRUCE LEHMAN

*Commissioner of Patents and Trademarks*